US005398761A

United States Patent [19]

Reynolds et al.

[11] Patent Number: 5,398,761

[45] Date of Patent: Mar. 21, 1995

[54] SUBSEA BLOWOUT PREVENTER MODULAR CONTROL POD

[75] Inventors: Graeme E. Reynolds; M. M. Barrier; Daniel J. Pesek, all of Houston, Tex.

[73] Assignee: Syntron, Inc., Houston, Tex.

[21] Appl. No.: 56,716

[22] Filed: May 3, 1993

[51] Int. Cl.[6] ..... E21B 33/064

[52] U.S. Cl. ..... 166/344; 166/356; 166/363

[58] Field of Search ..... 166/338, 339, 341, 344, 166/345, 351, 356, 363, 368

[56] References Cited

U.S. PATENT DOCUMENTS

| | | | |
|---|---|---|---|
| 3,840,071 | 10/1974 | Baugh et al. | 166/344 X |
| 4,219,223 | 8/1980 | Schulte | 285/26 |
| 4,411,454 | 10/1983 | Nayler et al. | 285/26 |
| 4,457,489 | 7/1984 | Gilmore | 166/344 X |
| 4,460,156 | 7/1984 | Hazelrigg et al. | 166/344 X |
| 4,637,419 | 1/1987 | Hughes | 166/319 X |
| 4,637,470 | 1/1987 | Weathers et al. | 166/344 |
| 4,852,611 | 8/1989 | Knerr et al. | 137/595 |
| 4,899,822 | 2/1990 | Daeschler et al. | 166/344 X |
| 5,042,530 | 8/1991 | Good et al. | 166/336 X |

OTHER PUBLICATIONS

Composite Catalog of Oilfield Equipment and Services, 1982–83, vol. 3, pp. 4559–4561, published by World Oil.

*Primary Examiner*—Roger J. Schoeppel

*Attorney, Agent, or Firm*—Pravel, Hewitt, Kimball & Krieger

[57] ABSTRACT

A modular subsea control pod assembly having a retrievable pod assembly and a receptacle assembly. The retrievable pod assembly has a stab block and at least one function port having an opening in the stab block. The retrievable pod assembly includes a pod gate which is adapted to move between a first position in which the pod gate covers the function port opening and a second position in which the pod gate does not cover the function port opening. The receptacle assembly includes a receptacle base module adapted to receive the stab block and a receptacle function port adapted to be connected to a blowout preventer hydraulic operator. The receptacle assembly includes a receptacle gate which is adapted to move between a first position in which the receptacle gate covers the receptacle function port opening and a second position in which the receptacle gate does not cover the receptacle function port opening. Seal assemblies are provided to operate with the pod gates and the receptacle gates to seal the function and receptacle function ports against the intrusion of saltwater.

10 Claims, 10 Drawing Sheets

FIG. 3
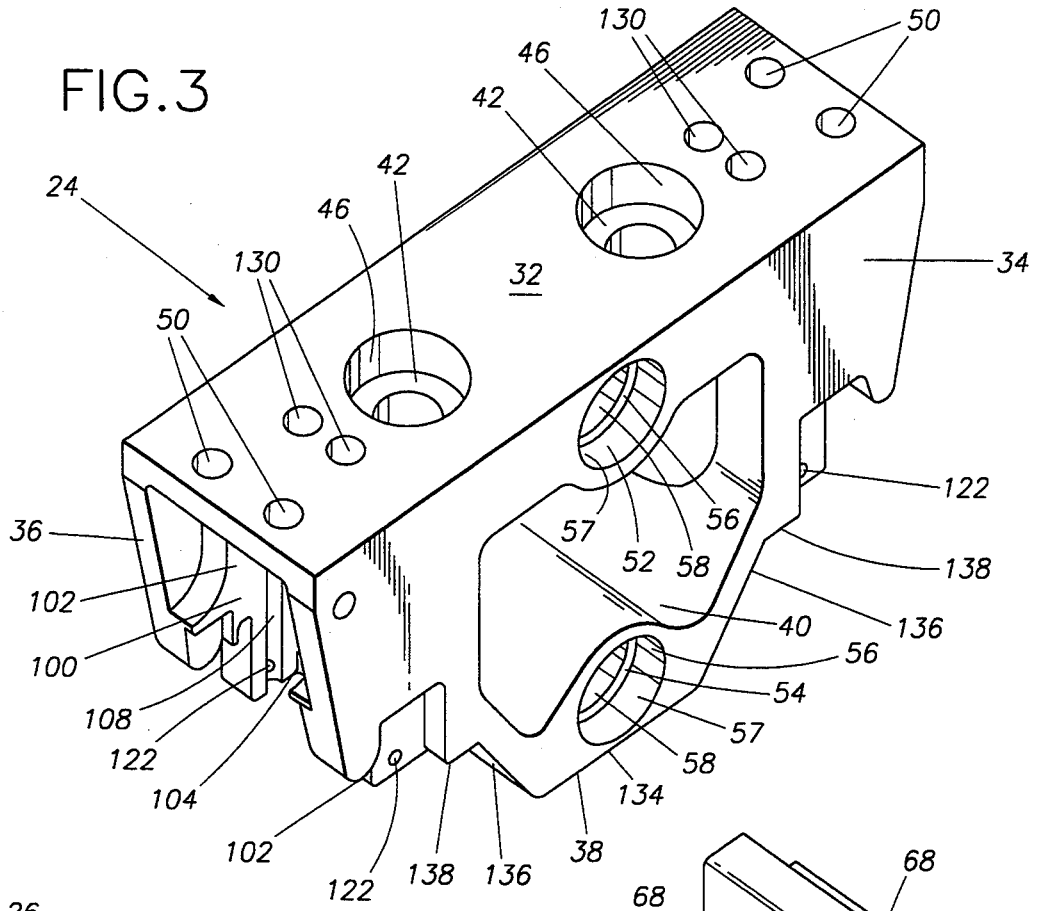
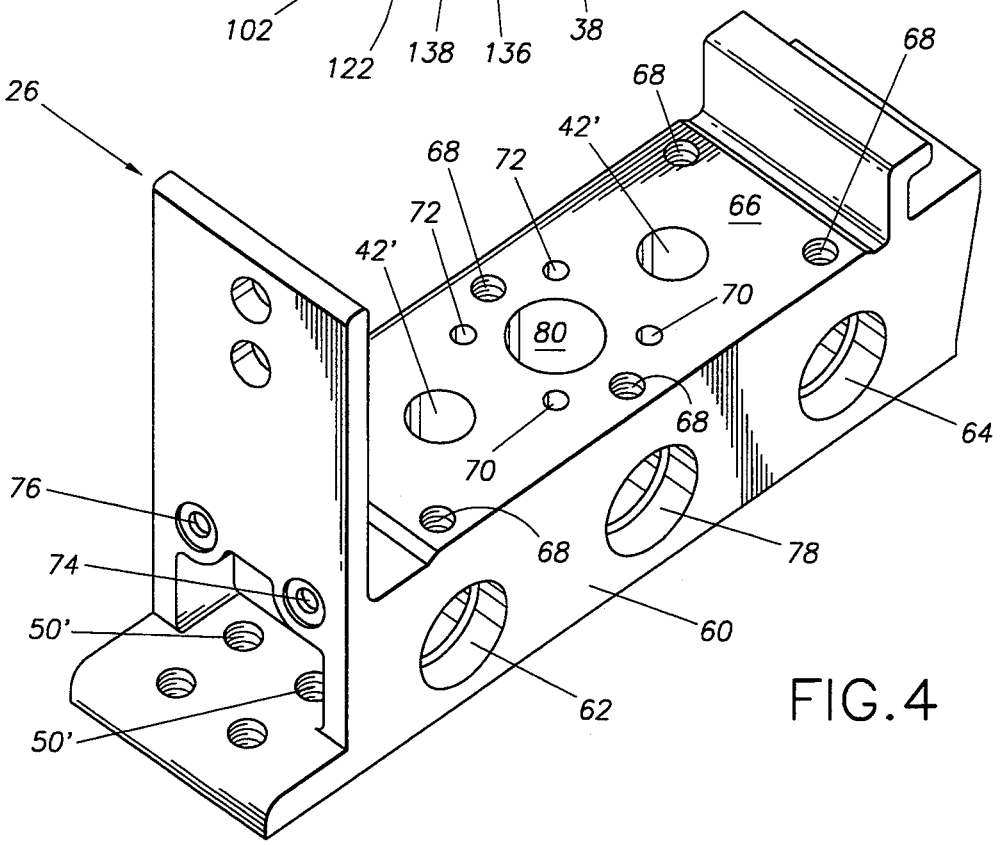
FIG. 4

SUBSEA BLOWOUT PREVENTER MODULAR CONTROL POD

BACKGROUND OF THE INVENTION

1. Field of the Invention

The present invention relates to subsea blowout preventer control pods.

2. Description of the Prior Art

Blowout preventers, referred to in the oil and gas industry as BOPs, are used to prevent blowouts during the drilling and production of oil and gas wells. The BOPs are installed at the wellhead for the purpose of preventing the escape of pressure in an annular space between the casing and drill pipe or in an open hole during drilling and completion operations. On floating offshore rigs, such as semisubmersibles and drill ships, the BOPs are attached to the well on the seafloor.

BOPs are large, high-pressure valves capable of being remotely controlled. There are two basic types of BOPs—annular and ram. Typically, a plurality of BOPs are stacked on top of one another and referred to as a BOP stack. The BOP stack is attached to the wellhead.

Next to the BOPs, the most important well control component is the system that monitors and controls the behavior of the subsea BOPs from the drilling rig. One of the components of the system that monitors and controls the behavior of the subsea BOPs is a subsea control pod. The subsea control pod is adapted to mount to the subsea BOP stack and provide a means of actuating and controlling the subsea BOP stack from the drilling vessel. Hydraulic lines from the drilling rig enter the subsea control pod, and the fluid is directed to the BOPs. The subsea control pod contains pilot operated control valves and pilot operated regulators which direct hydraulic fluids to the various BOP hydraulic operators controlling the BOP functions. Typically, two subsea control pods are used so that, should one fail, the other can be employed.

Subsea control pods are typically of the retrievable type as opposed to the nonretrievable type. The retrievable subsea control pod has a male portion containing the pod valves, regulators, and hose bundle junction box. The retrievable control pod can be retrieved if there are malfunctions of the pod valves, regulator or hose bundle without retrieving any additional equipment.

The retrievable male portion of the control pod is latched into the subsea female portion by hydraulic latching or jacking means. The retrievable male portion and the female portion of the subsea control pod include fluid ports which align and seal with one another when the male and female portions of the subsea control pod are mated. The fluid ports provide the hydraulic passageways for actuating the functions on the BOP stack. Typically, the fluid ports of the male and female portions of the control pod are exposed to the seawater when the portions are not mated. The intrusion of the saltwater into the BOP stack hydraulic operators and the control pod results in corrosion and galling of components and detrimentally effects the reliability and integrity of the entire system.

As drilling operations have moved into the harsh deep water environment, subsea system reliability has become of utmost importance. A significant shortcoming of the prior art subsea control pods is their susceptibility to salt water intrusion into the BOP stack hydraulic operators and the pod during testing, running, and retrieval operations.

Another disadvantage of the prior art is that the subsea pods cannot be expanded or reduced to accommodate the operator's specified BOP stack functions. The number of specified functions to be controlled by the subsea pod is dependent on several factors including operator's preference, the type of well, safety, etc.

It is desirable to have a subsea control pod assembly having modular components so that it allows the versatility to be expanded or reduced, as necessary. It is also desirable to have a male and female portion having sealing gate assemblies which prevent saltwater intrusion into the BOP stack hydraulic operators and the control pod during deployment and retrieval of the male portion of the subsea control pod. It is desirable to have the subsea control pod assembly made from materials resilient to the corrosive effects of saltwater and yet be compatible with each other on the galling and galvanic scales.

SUMMARY OF THE PRESENT INVENTION

Briefly, the present invention subsea control pod assembly having modular components which allow the subsea control pod to be expanded or reduced, as necessary. The subsea control pod assembly has a retrievable male pod assembly and female receptacle assembly. The retrievable pod assembly and the receptacle assembly have sealing gate assemblies which prevent saltwater intrusion into the BOP stack hydraulic operators and the control pod assembly during deployment and retrieval of the retrievable pod assembly. The subsea control pod assembly is made from materials exhibiting excellent resistance to the corrosive effects of saltwater while being compatible with each other on the galling and galvanic scales.

BRIEF DESCRIPTION OF THE DRAWINGS

In order to more fully understand the drawings referred to in the detailed description of the present invention, a brief description of each drawing is presented, in which:

FIG. 3 is an elevational perspective view of the pod stab block;

FIG. 4 is an elevational perspective view of the manifold feeder block;

DETAILED DESCRIPTION OF THE INVENTION

Figure 1B:
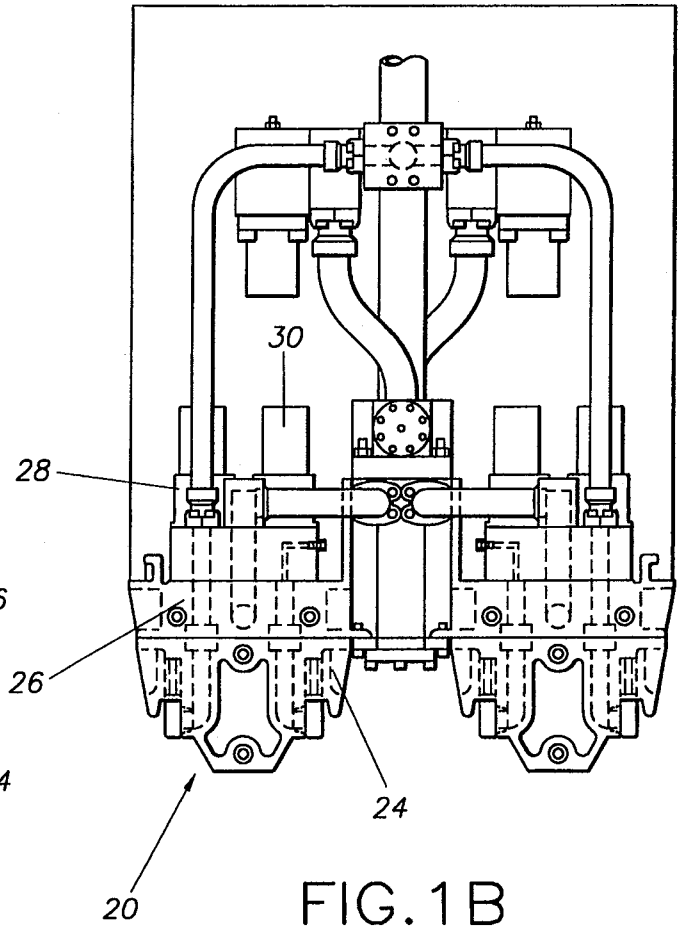
FIG. 1B is an end elevational view of the retrievable pod assembly.
Figure 1A:
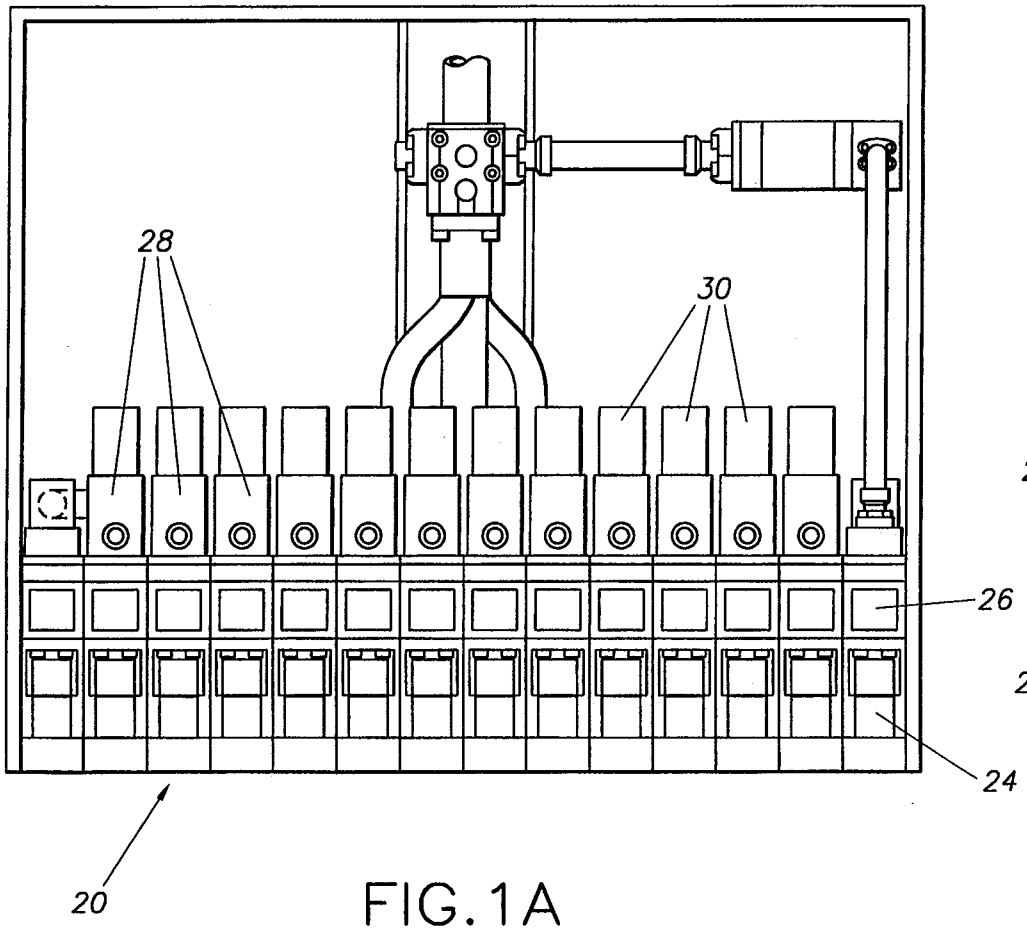
FIG. 1A is a side elevational view of the retrievable pod assembly of the subsea control pod assembly according to the present invention.
Figure 1C:
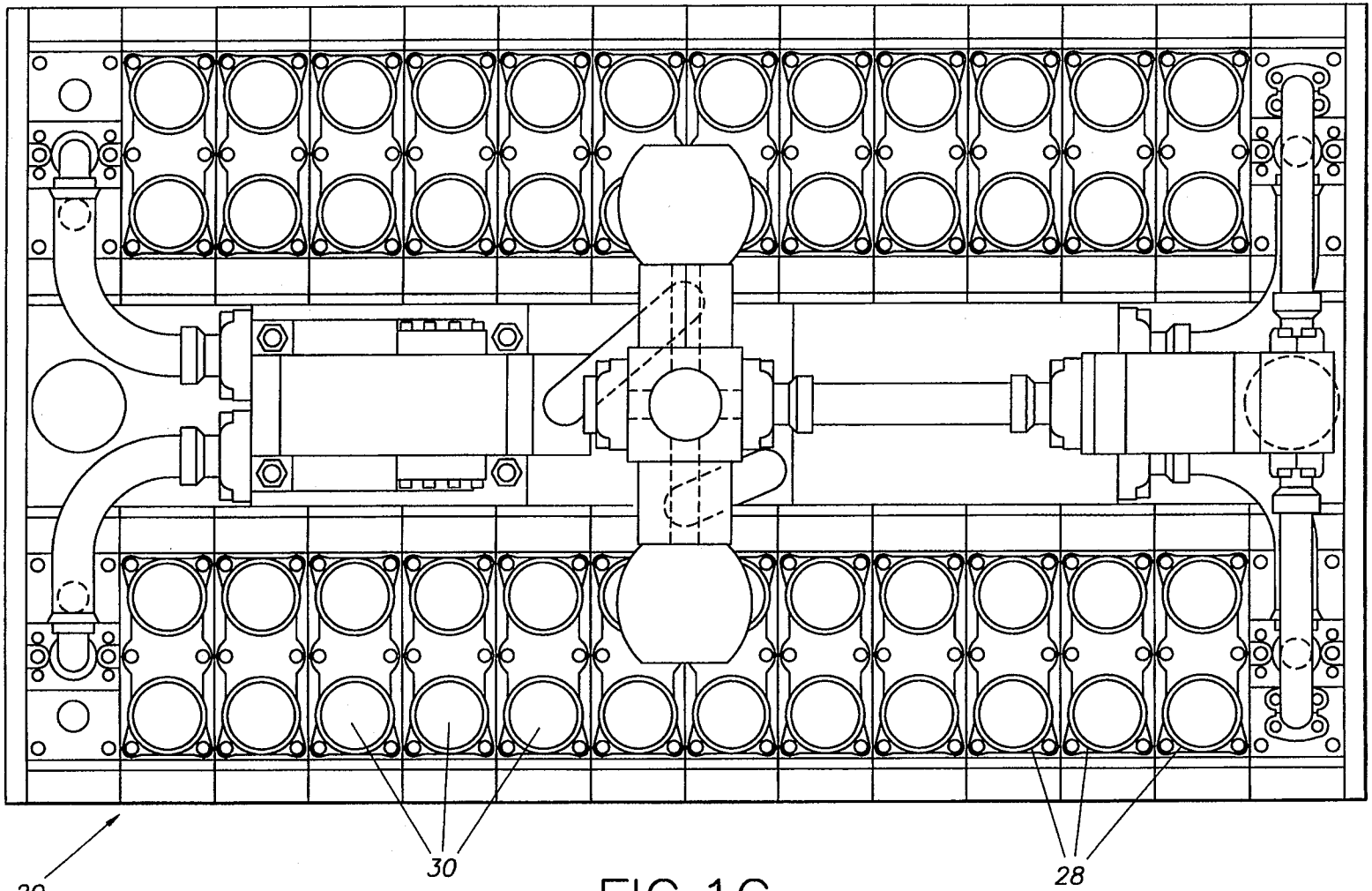
FIG. 1C is a top plan view of the retrievable pod assembly.

Referring now to the drawings in greater detail, the subsea control pod assembly according to the present invention includes a retrievable pod assembly, designated generally by the numeral 20, as shown in FIGS. 1A, 1B, and 1C.

Figure 2:
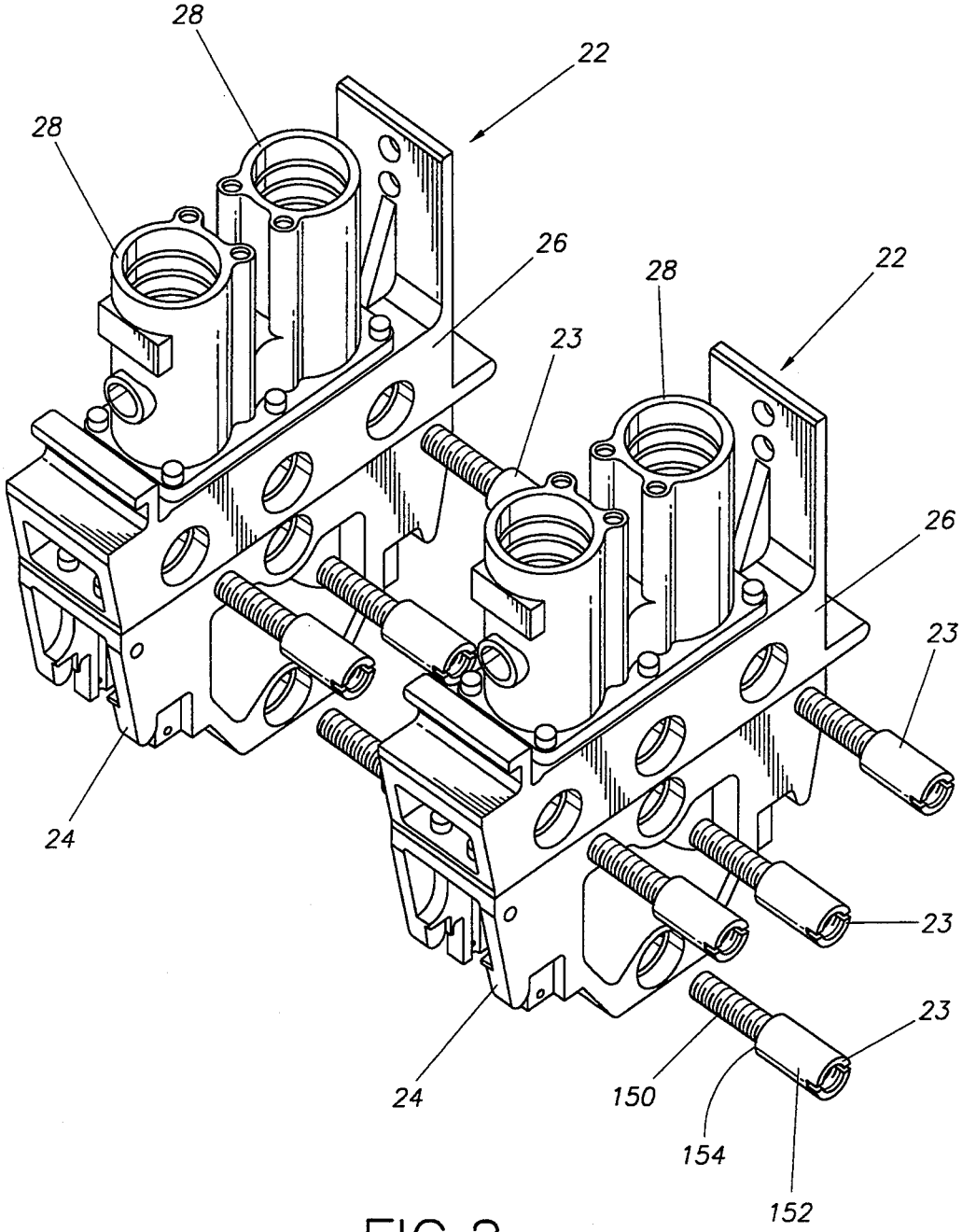
FIG. 2 is an exploded elevational perspective view showing the modular bolting arrangement of two modular units including the pod stab block, manifold feeder block, valve and valve pocket modules.

The retrievable pod assembly 20 includes a plurality of modular components which build on one another to form modular units, designated generally as 22, as shown in FIG. 2. The modular units 22 are interconnected with one another by fastening means 23 to form the retrievable pod assembly 20. In FIG. 2, the fastening means has been shown as threaded fasteners 23 although it is to be understood that other types of fastening means may be used to interconnect the modular units 22 to one another. Preferably, the fastening means 23 are removable so that the retrievable pod assembly 20 can be expanded or reduced in size depending on the specific requirements of the operator.

Figure 13:
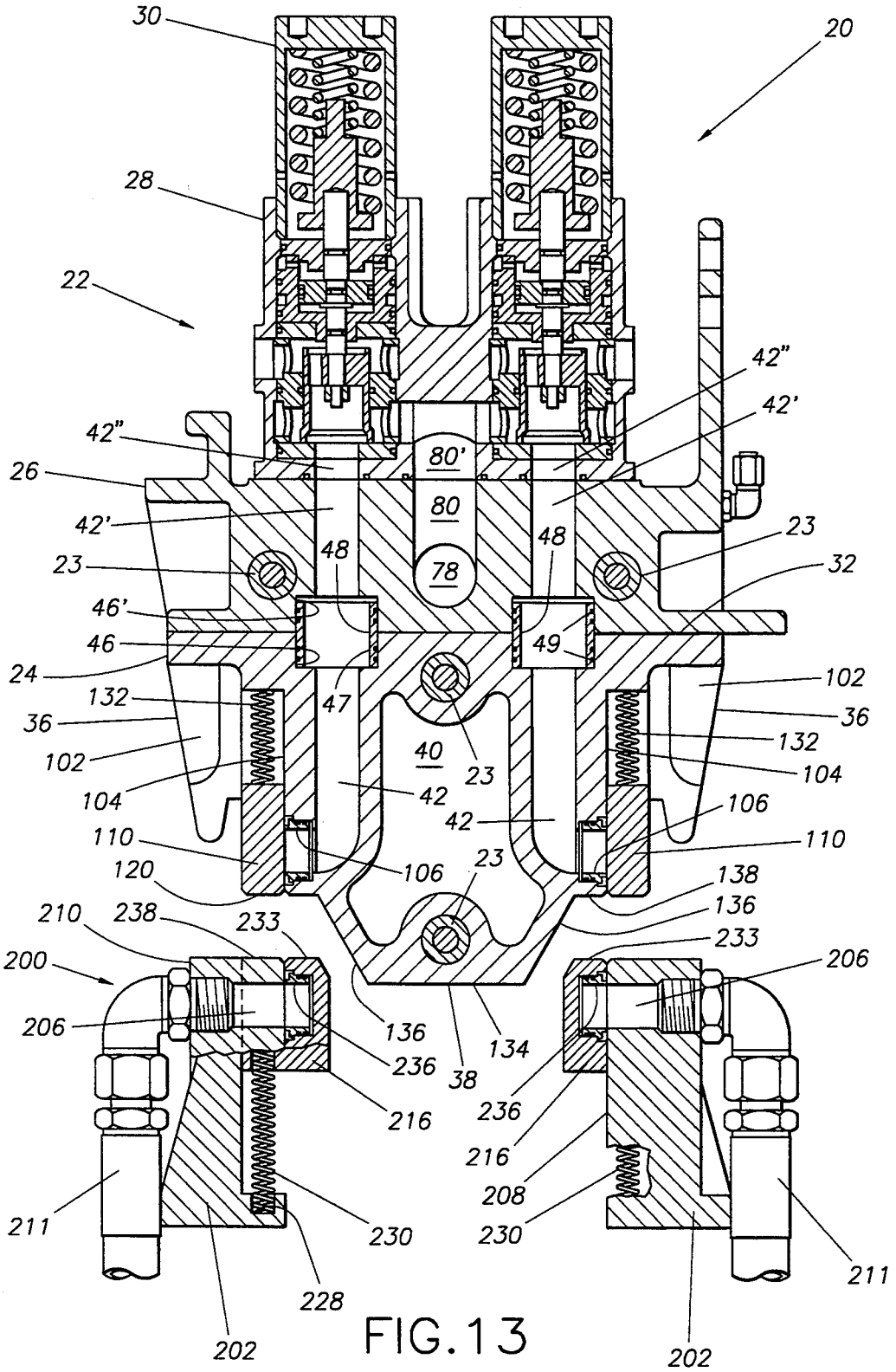
FIG. 13 is an elevational cross-sectional view of the subsea control pod assembly in the disengaged position with the receptacle and pod gates closing their respective ports.

The modular components to assemble the modular units 22 will be described with reference to FIGS. 2, 3, 4, 5, 13 and 14. Referring to FIGS. 2 and 13, the modular unit 22 includes a pod stab block 24, a manifold feeder block 26, a valve pocket 28 and a subplate mounted valve 30, typically referred to as a SPM valve. Preferably, the pod stab block 24, the manifold feeder block 26, and the valve pocket 28 are cast in "NITRONIC" 50 stainless steel which has been found to provide long service life in a high pressure corrosive environment. "NITRONIC" is a registered trademark of Armco, Inc.

Figure 14:
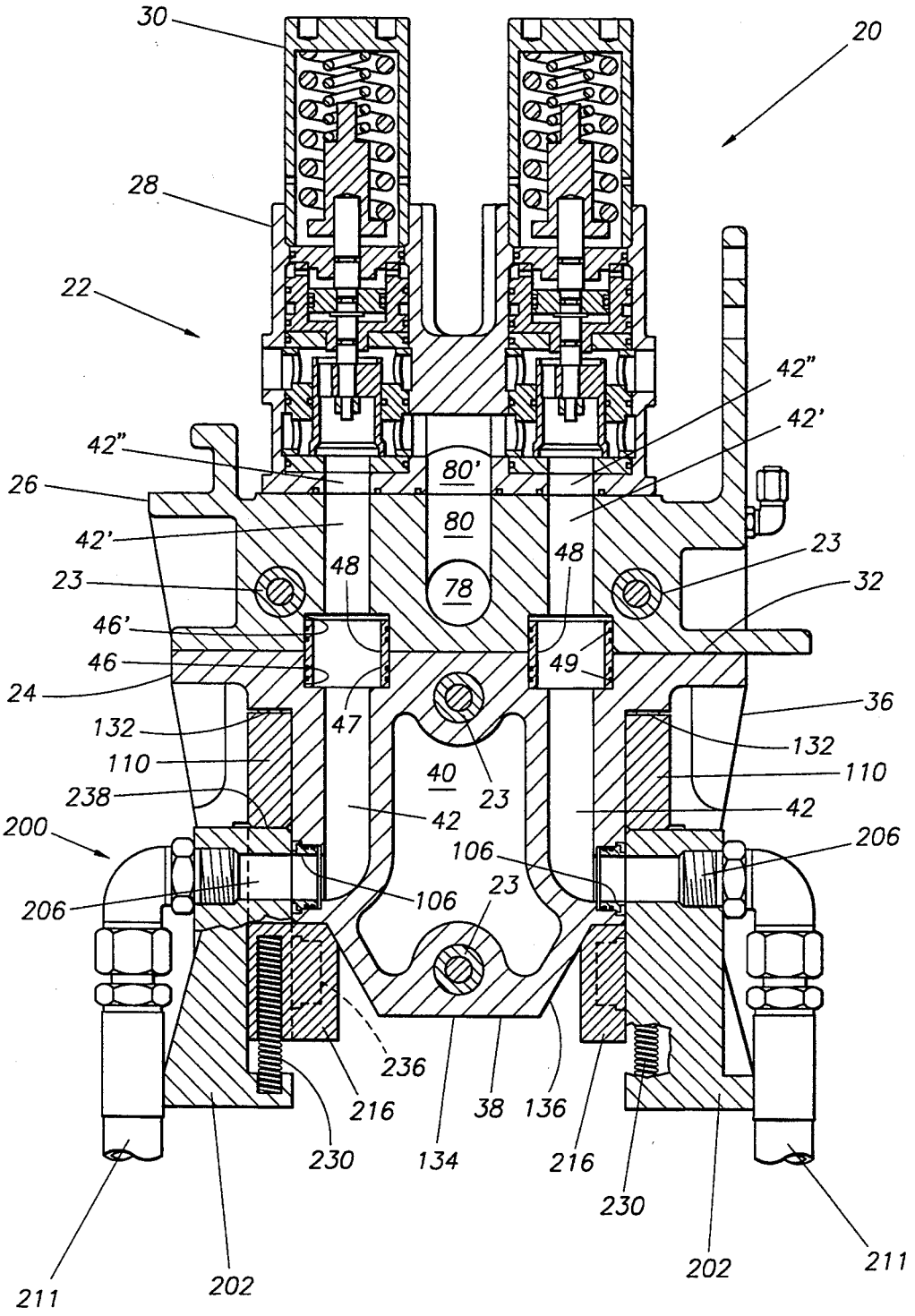
FIG. 14 is an elevational cross-sectional view of the subsea control pod assembly in the engaged position with the receptacle and pod gates retracted from their respective ports.
Figure 15:
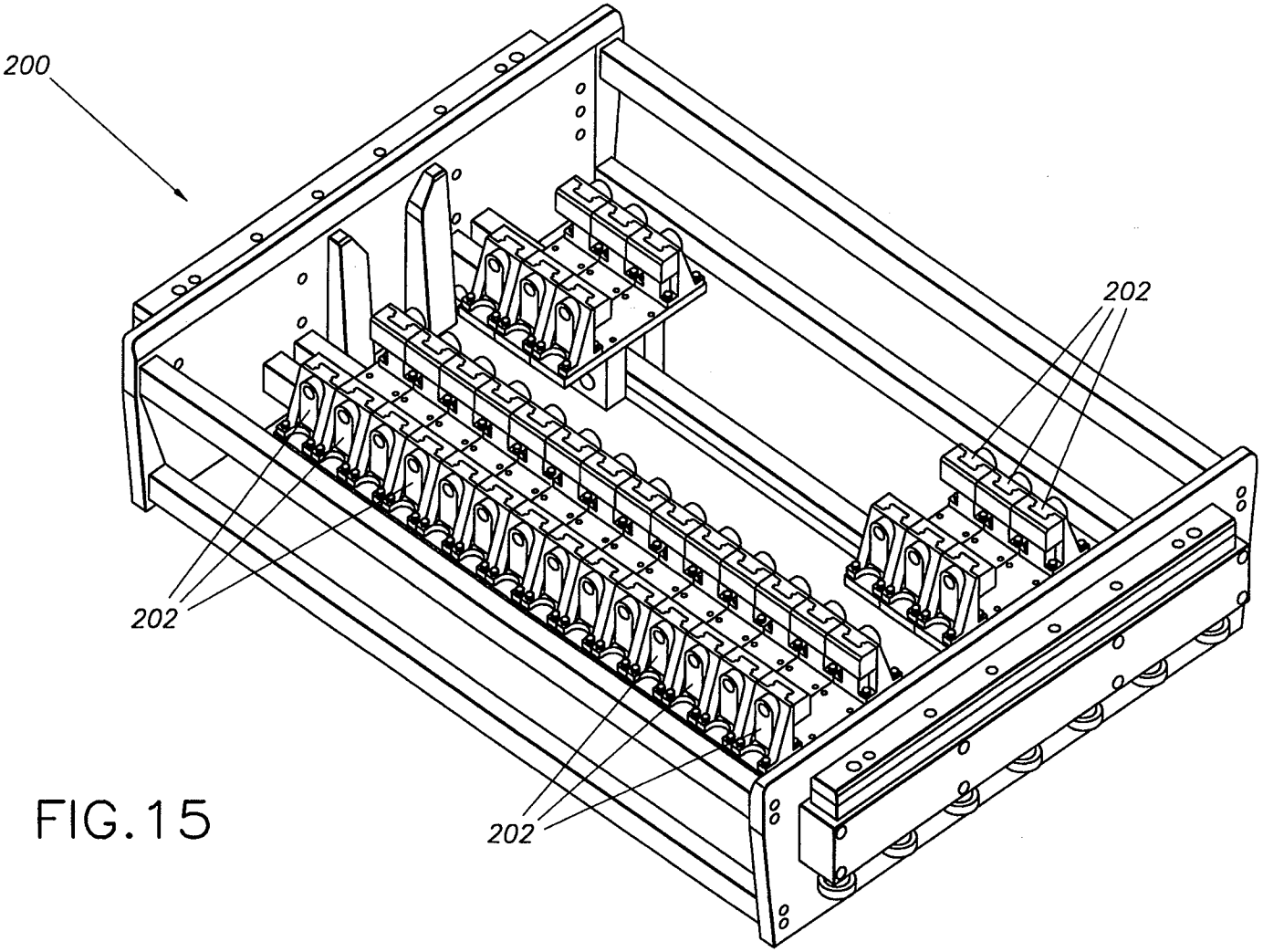
FIG. 15 is a top perspective view of the receptacle assembly of the subsea control pod assembly according to the present invention.

The pod stab block 24 interfaces the retrievable pod assembly 20 to a female receptacle assembly 200 as shown in FIGS. 13, 14 and 15. The pod stab block is shown separately in FIG. 3. The pod stab block 24 includes a planar upper face 32 and planar front and rear faces 34. The front and rear faces 34 are identical to one another. The pod stab block 24 includes symmetrical sides 36 which taper inwardly from the upper face 32 towards a lower face 38. Referring to FIGS. 3 and 13, the pod stab block 24 includes a central opening 40 to minimize the amount of material and weight. A pair of function ports 42 extend from the upper face 32 to the vertical recessed faces 104 of the pod stab block 24. The upper end portion of the function ports 42 include enlarged seat portions 46 for receiving interface seal subs 48 as shown in FIGS. 13 and 14. The interface seal subs 48 include a sleeve 47 with two pairs of o-rings 49 peripherally mounted to the sleeve 47. The interface seal subs 48 provide hydraulic integrity between the pod stab block 24 and the manifold feeder block 26. It is to be understood that the interface seal sub 48 includes various other sealing means which are common in the industry and is not limited to the sleeve and o-ring assembly described above.

Two pairs of mounting holes 50 in the upper face 32 are provided for mounting the manifold feeder block 26 to the pod stab block 24. An upper and lower bore, 52 and 54 respectively, extends from the front face 34 through to the rear face of the pod stab block 24. As shown in FIG. 3, the upper and lower bores 52 and 54, respectively, include an interior shoulder 56 defining an outer bore 57 and an inner bore 58 of reduced diameter.

As shown in FIG. 2, the fastening means 23 includes a male threaded portion 150 and a female threaded portion 152. The male threaded portion 150 is sized to threadably engage the female threaded portion 152 of a second fastener 23. The threaded fastener 23 includes a stepped shoulder 154 at the transition from the male threaded portion 150 to the female threaded portion 152. The female threaded portion 152 has an external diameter corresponding generally to the diameter of the outer bore 57 (FIG. 3). The stepped shoulder 154 abuts the interior shoulder 56 (FIG. 3) of the pod stab block 24. The male threaded portion 150 extends through the inner bore 58 (FIG. 3) where it engages the female threaded portion 152 of the threaded fastener 23.

Mounted to the upper face 32 of the pod stab block 24 is the manifold feeder block 26. The manifold feeder block 26 provides the hydraulic interface between the SPM valves 30, the pod stab block 24 and the modular unit-to-modular unit throughout the retrievable pod assembly 20. The manifold feeder block 26 includes two pairs of mounting holes 50' corresponding to the mounting holes 50 in the pod stab block 24. The manifold feeder block 26 includes a front face 60 and a rear face (not shown). A pair of bores 62 and 64 extend from the front face 60 to the rear face and include an inner shoulder (not shown) as described above for upper and lower bores 52 and 54. The manifold feeder block 26 includes a planar upper face 66. The planar upper face 66 includes a plurality of mounting holes 68 corresponding to a plurality of mounting holes 68' in the valve pocket 28. Preferably, the mounting holes 68 are threaded holes for receiving threaded fasteners (not shown). The upper face 66 includes a first pair of pilot ports 70 and a second pair of pilot ports 72. The pairs of pilot ports 70 and 72 have a pilot port inlet 74 and 76, respectively. The manifold feeder block 26 includes a main fluid bore 78 extending through the manifold feeder block 26. The main fluid bore 78 branches vertically with a main feed bore 80 to the upper face 66. The manifold feeder block 26 includes a pair of function ports 42' extending vertically through the manifold feeder block 26. The lower end portion of the function ports 42' include enlarged seat portions 46' for receiving interface seal subs 48 as shown in FIGS. 13 and 14 and as described above.

Figure 5:
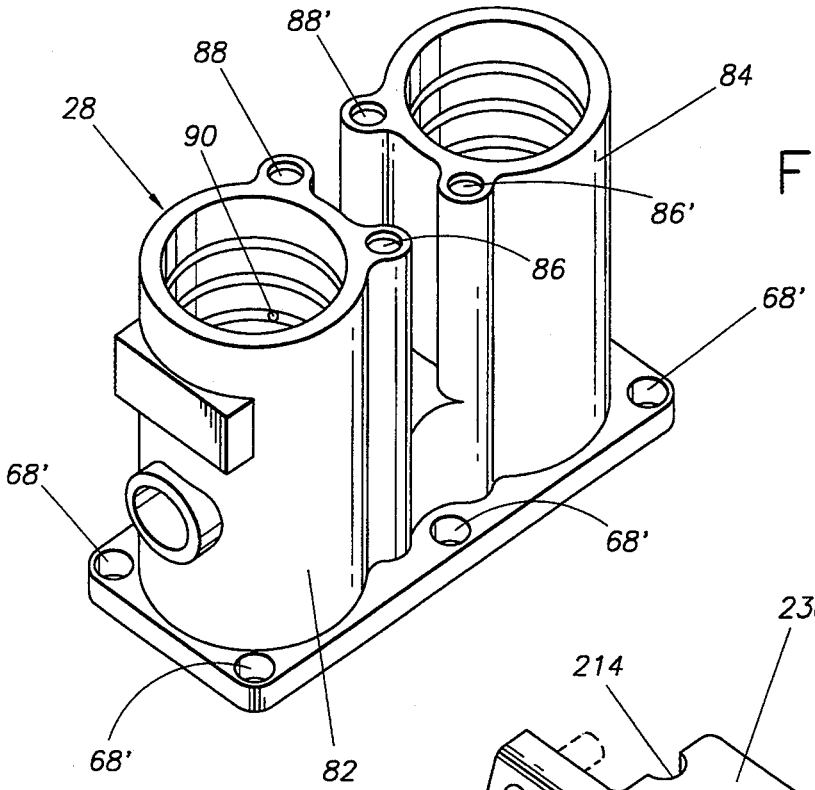
FIG. 5 is an elevational perspective view of the valve pockets.

Referring to FIG. 5, the valve pocket 28 includes a pair of vertical cylinders 82 and 84 which receive the SPM valve assembly 30. Referring to FIGS. 13 and 14, the valve pocket 28 includes a pair of function port openings 42'' through the base of the cylinders 82 and 84 of the valve pocket 28. A main feed bore 80' extends into the base of valve pocket 28 before branching horizontally to the cylinders 82 and 84. The valve pocket 28 has a first pair of pilot lines 86 and 86' and a second pair of pilot lines 88 and 88' which matingly correspond with the pair of pilot ports 70 and 72. Although not shown in FIG. 5, the upper ends of the pilot lines 86 and 88 are plugged during the operation of the control pod. In the preferred embodiment, each pair of pilot lines has one pilot line with an upper port and the second pilot line with a lower port. Referring to FIG. 5, the pilot line 88 has an upper port 90 whereas the pilot line 88' has a lower port (not shown). Similarly, the pilot line 86 has a lower port (not shown) whereas the pilot line 86' has an upper port (not shown). The SPM valve 30 is installed in the valve pocket 28 as shown in FIG. 13. The porting arrangement provides a dual cross piloted SPM valve pocket having redundant valve operation which also minimizes interflow. The dual cross piloted SPM valve pocket 28 operates such that when one SPM valve 30 is open the other SPM valve 30 is closed. When the SPM valve 30 is open, hydraulic fluid flows from the main fluid bore 78 of the manifold feeder block 26 to the main feed bore 80 through the valve pocket 28 and on through the function ports 42", 42' and 42.

Figure 6:
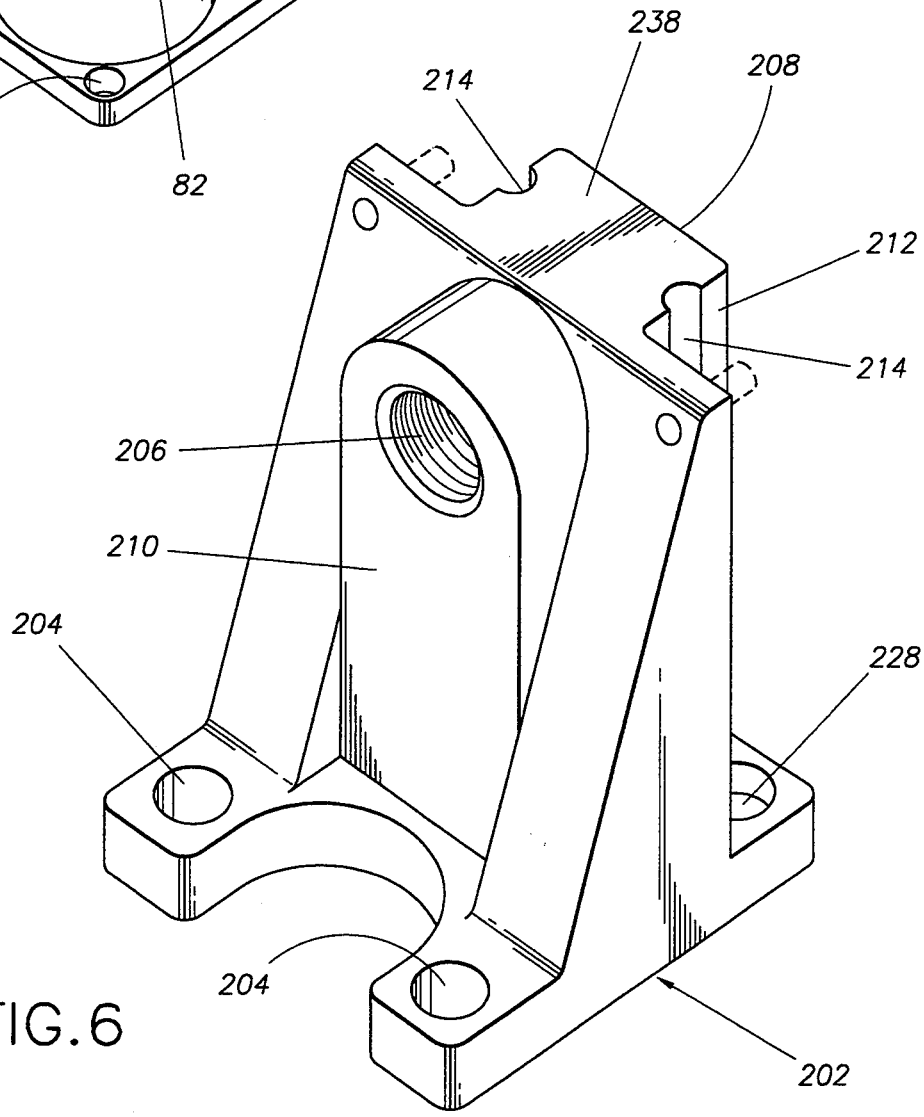
FIG. 6 is an elevational perspective view of the pod receptacle base module.
Figure 7:
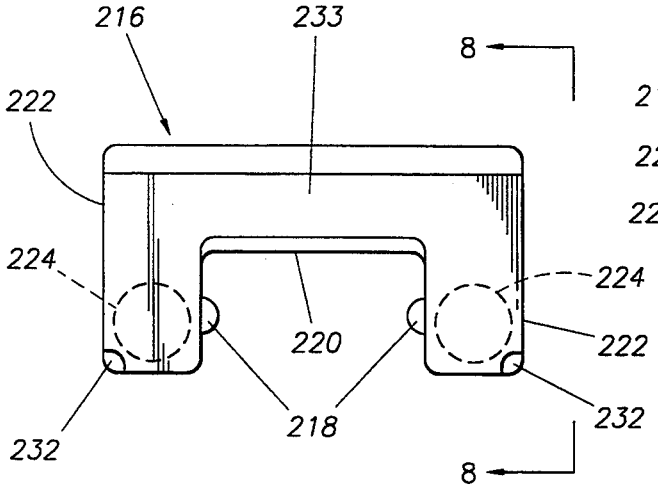
FIG. 7 is a top view of the receptacle gate.
Figure 8:
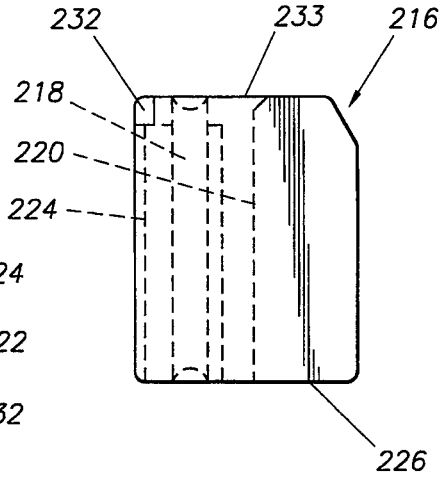
FIG. 8 is a view taken along line 8—8 of FIG. 7.
Figure 9:
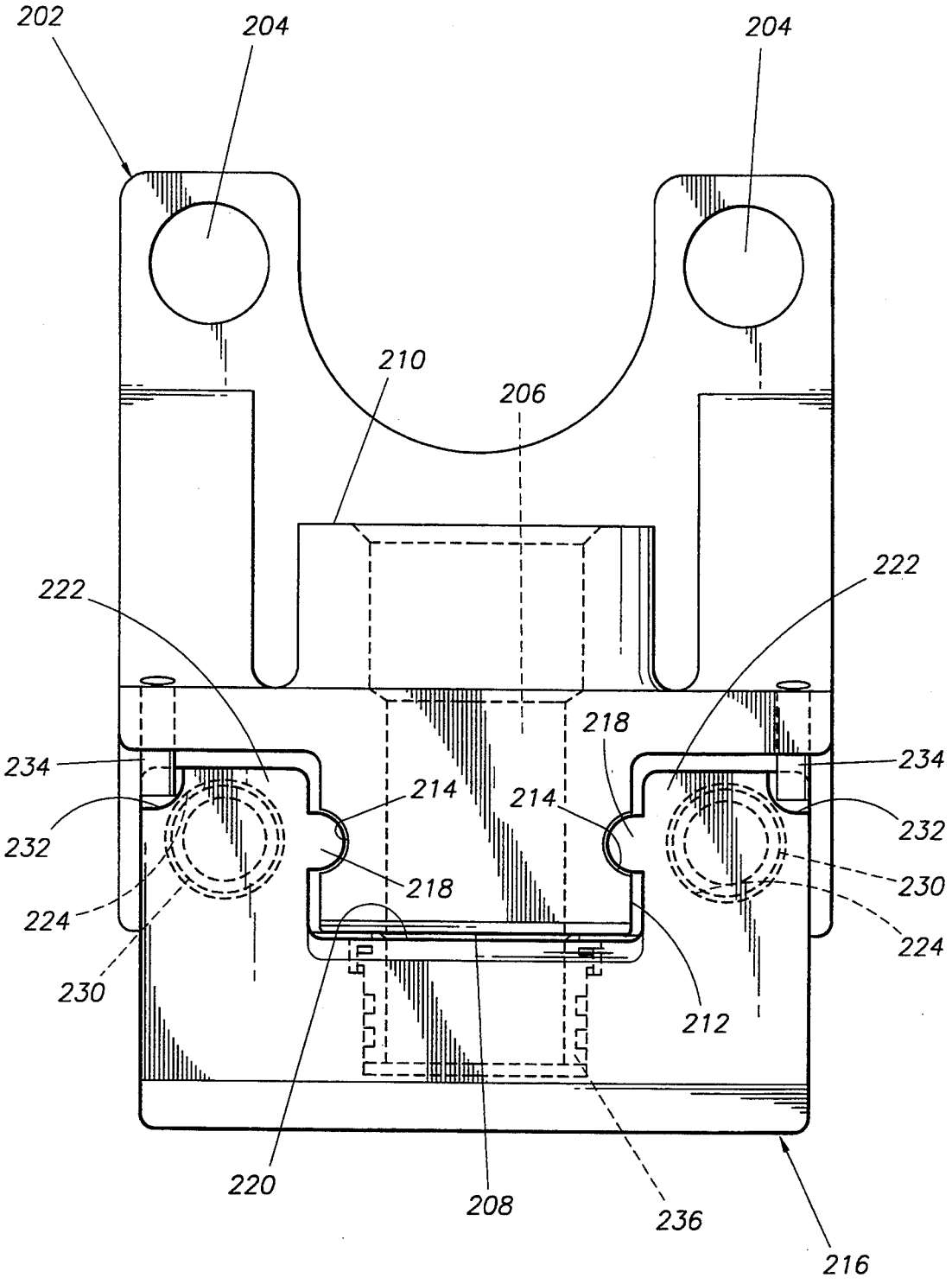
FIG. 9 is a top view of the pod receptacle base module and receptacle gate.

The female receptacle assembly 200 is shown in FIGS. 13 and 14. The female receptacle assembly 200 is also modular so that it can be expanded or reduced as needed. The female receptacle assembly 200 includes a receptacle base module 202 as shown in FIG. 6. The receptacle base module 202 has a plurality of mounting holes 204 for mounting the receptacle base module 202 to the female receptacle assembly 200. The receptacle base module 202 includes a receptacle function port 206 extending through the base module 202 from a first planar face 208 to a second planar face 210 of the base module 202 as shown in FIGS. 13 and 14. Referring to FIGS. 13 and 14, the receptacle function port 206 is connected at the second planar face 210 to piping 211 which goes to the BOP stack. Referring to FIGS. 6 and 9, the receptacle base module 202 includes a vertical guide member 212 having a plurality of longitudinal grooves 214 therein. Referring to FIG. 7, a receptacle gate 216 has a smooth, planar inner face 220 and a leg 222 at each end of the receptacle gate 216. Each leg 222 of the receptacle gate 216 is shown having a longitudinal ridge 218. The ridges 218 of the receptacle gate 216 slidingly engage the longitudinal grooves 214 of the receptacle base module 202 as shown in FIG. 9. Referring to FIGS. 7, 8, and 9, the receptacle gate 216 has a pair of longitudinal blind bores 224 which open at the lower face 226 of the receptacle gate 216. The blind bores 224 are aligned with a pair of bores 228 spaced on either side of the vertical guide member 212 of the receptacle base module 202.

Referring to FIGS. 9 and 13, a receptacle gate spring 230 is positioned in the blind bore 224 of the receptacle gate 216 and the aligned bore 228 of the receptacle base module 202. An identical second receptacle gate spring 230 is installed on the opposite side of the vertical guide member 212. The pair of receptacle gate springs 230 maintain the receptacle gate in a normal closed position as shown in FIG. 13 such that the receptacle gate 216 covers the receptacle function port 206 of the receptacle base module 202. Referring to FIGS. 7, 8, and 9, the receptacle gate 216 includes a pair of upper notches 232 in the upper face 233 of the receptacle gate 216. The receptacle base module 202 includes a pair of upper stops 234 which engage the upper notches 232 and prevent further upward movement of the receptacle gate 216 as shown in FIG. 9.

Referring to FIGS. 13 and 14, the receptacle gate 216 includes a receptacle gate seal 236. Preferably, the receptacle gate seal 236 is a spring-loaded seal in which a spring, such as a wave spring, provides the initial sealing force and fluid pressure provides the final sealing force against the first planar face 208 of the receptacle base module 202. When in the normal closed position as shown in FIG. 13, the receptacle gate 216 and the receptacle gate seal 236 prevent saltwater intrusion to the BOP hydraulic operators during testing, running and retrieving operations.

Referring to FIGS. 3 and 13, the pod stab block 24 includes a pair of side recessed portions 100 having a pair of side walls 102 and a rear wall 104. Preferably, the side walls 102 and the rear wall 104 are vertical walls. The function ports 42 have an opening at the lower portion of the rear walls 104 as shown in FIG. 13. Referring to FIG. 13, the pod stab block 24 includes a pod gate seal 106 at the function port opening in the rear walls 104. Preferably, the pod gate seal 106 is a spring-loaded seal like the receptacle gate seal 236 described above.

Figure 10:
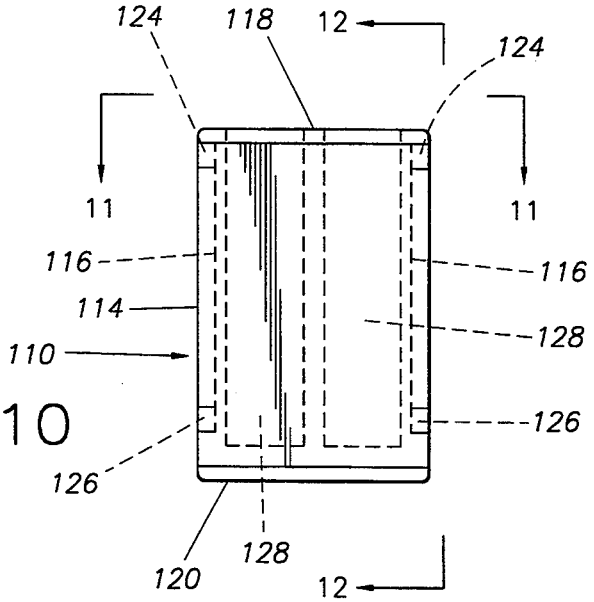
FIG. 10 is an elevational view of the pod gate.
Figure 11:
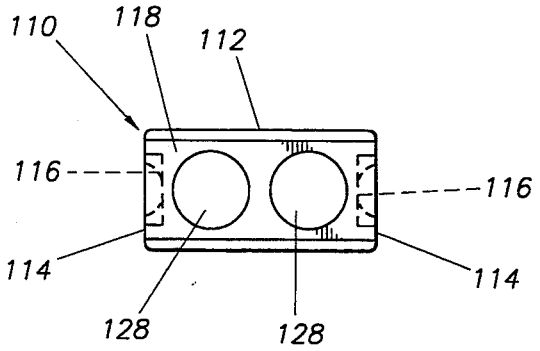
FIG. 11 is a view taken along line 11—11 of FIG. 10.
Figure 12:
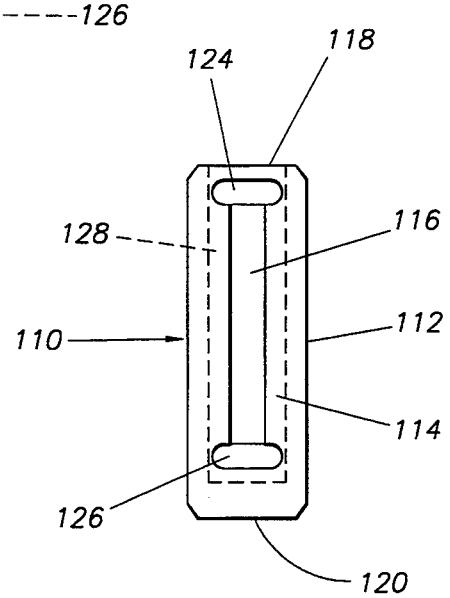
FIG. 12 is a view taken along line 12—12 of FIG. 10.

Referring to FIG. 3, the side walls 102 of the pod stab block 24 include a longitudinal channel 108 therein. Referring to FIGS. 10, 11 and 12, a pod gate 110 has a smooth, planar inner face 112 and a pair of sides 114 having a longitudinal gate channel 116 terminating near the upper and lower faces 118 and 120, respectively, of the pod gate 110. The longitudinal gate channel 116 corresponds to the longitudinal channel 108 of the pod stab block 24. A cylindrical dowel rod (not shown) having a diameter slightly less than the diameter of the longitudinal channel 108 and the longitudinal gate channel 116 is positioned in the channels 108 and 116 and the pod gate 110 is installed between the side walls 102 of the pod stab block 24. The dowel rod permits sliding movement of the pod gate 110 relative to the side walls 102 of the pod stab block 24 and prevents lateral movement of the pod gate 110 relative to the pod stab block 24. Upper and lower end portions 124 and 126, respectively, of the longitudinal gate channel 116 maintain the dowel rod in the longitudinal gate channel 116. The side walls 102 include a lower hole 122 for receiving a pod gate stop pin (not shown) which prevents the dislocation of the pod gate 110 from the pod stab block 24.

Referring to FIGS. 10, 11, and 12, the pod gate 110 has a pair of longitudinal blind bores 128 which open at the upper face 118 of the pod gate 110. The blind bores 128 are aligned with a pair of bores 130 in the pod stab block 24. Referring to FIGS. 10, 13 and 14, a pod gate spring 132 is positioned in each blind bore 128 of the pod gate 110 and the aligned bore 130 of the pod stab block 24. Although not shown, the upper end of the pod gate springs 132 abuts the lower face of the manifold feeder block 26. The pair of pod gate springs 132 maintain the pod gate 110 in a normal closed position as shown in FIG. 13 such that the pod gate 110 covers the opening of the function port 42 of the pod stab block 24.

In the normal closed position as shown in FIG. 13, the pod gate 110 and the pod gate seal 106 prevent saltwater intrusion into the retrievable pod assembly 20 during testing, running and retrieving operations.

Referring to FIGS. 13 and 14, the subsea control pod assembly is shown in the disengaged and the engaged positions respectively. As previously discussed, the receptacle and pod gates 216 and 110, respectively, close their respective ports 206 and 42 in the disengaged position to prevent saltwater intrusion therein.

As shown in FIGS. 3, 13 and 14, the pod stab block 24 includes a lower face 38 having a generally horizontal central portion 134 which meets upwardly angled side portions 136. The upwardly angled side portions 136 terminate with a generally horizontal end portion 138. As shown in FIGS. 13 and 14, the generally horizontal end portions 138 are vertically aligned with the upper face 233 of the receptacle gate 216 as the retrievable pod assembly 20 is lowered onto the female receptacle assembly 200. Similarly, the lower face 120 of the pod gate 110 is vertically aligned with an upper face 238 of the receptacle base module 202. As the retrievable pod assembly 20 is lowered onto the female receptacle assembly 200, the pod gates 110 and the receptacle gates 216 contact the upper face 238 of the receptacle base modules 202 and the lower end portions 138, respectively. The pod gates 110 slide vertically upwards in the longitudinal channels 108 thereby compressing the pod gate springs 132 and opening the function ports 42 to the receptacle function ports 206. Similarly, the receptacle gates 216 slide vertically downwards in the longitudinal grooves 214 thereby compressing the receptacle gate springs 230 and opening the receptacle function ports 206 to the function ports 42. The pod gate seal 106 forms the final seal between the function port 42 and the receptacle function port 206.

The foregoing disclosure and description of the invention is illustrative and explanatory thereof, and various changes in the size, shape, and materials, as well as in the details of illustrative construction and assembly, may be made without departing from the spirit of the invention.

We claim:

1. A subsea control pod assembly comprising:

a retrievable pod assembly having a stab block with an exterior surface and at least one function port having a first opening in said exterior surface of said stab block;

first means for releasably sealing the function port, said first means for releasably sealing mounted external of the function port;

a receptacle assembly having a receptacle base module adapted to receive said stab block, said receptacle base module having an outer surface and a receptacle function port having a first opening in said outer surface, the receptacle function port adapted to be connected to a blowout preventer hydraulic operator; and second means for releasably sealing the receptacle function port, said second means for releasably sealing mounted external of the receptacle function port, wherein the function port aligns with the receptacle function port when said stab block is received by said receptacle base module and said first and second means for releasably sealing the function port and the receptacle function port, respectively, operate to externally cover the respective first openings of the function port and the receptacle function port when said stab block is not received in said receptacle base module.

2. The subsea control pod assembly according to claim 1, wherein said first means for releasably sealing comprises:

a pod gate mounted to said exterior surface of said stab block; and first means for positioning said pod gate between a first position wherein said pod gate covers the first opening in said stab block and a second position wherein said pod gate does not cover the first opening in said stab block.

3. The subsea control pod assembly according to claim 2, wherein said first means for positioning comprises:

a plurality of channels in said stab block;

a plurality of corresponding channels in said pod gate;

a plurality of rods wherein one said rod is positioned between one channel in said stab block and one corresponding channel in said pod gate, said plurality of rods in slidable engagement with the plurality of channels in said stab block such that said pod gate is capable of movement along said exterior surface of said stab block; and at least one pod spring having a first end acting against said pod gate and a second end acting against said retrievable pod assembly such that said pod spring maintains said pod gate in said first position when said stab block is not received in said receptacle base module and said pod spring compresses when said stab block is received in said receptacle base module allowing said pod gate to slide away from the first opening in said stab block.

4. The subsea control pod assembly according to claim 1, wherein said second means for releasably sealing comprises:

a receptacle gate mounted to said outer surface of said receptacle base module; and second means for positioning said receptacle gate between a first position wherein said receptacle gate covers the first opening in said receptacle base module and a second position wherein said receptacle gate does not cover the first opening in said receptacle base module.

5. The subsea control pod assembly according to claim 4, wherein said second means for positioning comprises:

a plurality of grooves in said receptacle base module;

a plurality of ridges in said receptacle gate, said plurality of ridges in slidable engagement with the plurality of grooves such that said receptacle gate is capable of movement along said outer surface; and at least one spring having a first end acting against said receptacle gate and a second end acting against said receptacle base module such that said spring maintains said receptacle gate in said first position when said stab block is not received in said receptacle base module and said spring compresses when said stab block is received in said receptacle base module allowing said receptacle gate to slide away from the first opening in said receptacle base module.

6. A modular subsea control pod assembly comprising:

a retrievable pod assembly including a plurality of modular units, said modular units comprising:

a modular stab block and at least one function port;

a modular manifold feeder block adapted to be mounted to said modular stab block;

a modular valve pocket adapted to be mounted to said modular manifold feeder block; and means for connecting adjacent said modular units;

first means for releasably sealing the function port;

a receptacle assembly having a modular receptacle base module adapted to receive said modular stab block, said receptacle assembly including a receptacle function port adapted to be connected to a blowout preventer hydraulic operator; and second means for releasably sealing the receptacle function port, wherein the function port aligns with the receptacle function port when said modular stab block is received by said modular receptacle base module and said first and second means for releasably sealing the function port and the receptacle function port, respectively, operate to cover the respective ports when said modular stab block is not received in said modular receptacle base module.

7. The modular subsea control pod assembly according to claim 6, wherein the function port has a first opening in said modular stab block and said first means for releasably sealing comprises:

a pod gate; and first means for positioning said pod gate between a first position wherein said pod gate covers the first opening and a second position wherein said pod gate does not cover the first opening.

8. The modular subsea control pod assembly according to claim 7, wherein said modular stab block has an outer surface and said first means for positioning comprises:

a plurality of channels in said modular stab block;

a plurality of corresponding channels in said pod gate;

a plurality of rods wherein one said rod is positioned between one channel in said modular stab block and one corresponding channel in said pod gate, said plurality of rods in slidable engagement with the plurality of channels in said modular stab block such that said pod gate is capable of movement along said outer surface of said modular stab block; and at least one pod spring having a first end acting against said pod gate and a second end acting against said retrievable pod assembly such that said pod spring maintains said pod gate in said first position when said modular stab block is not received in said modular receptacle base module and said pod spring compresses when said modular stab block is received in said modular receptacle base module allowing said pod gate to slide away from the first opening in said modular stab block.

9. The modular subsea control pod assembly according to claim 6, wherein the receptacle function port has a first opening in said modular receptacle base module and said second means for releasably sealing comprises:

a receptacle gate; and second means for positioning said receptacle gate between a first position wherein said receptacle gate covers the first opening in said modular receptacle base module and a second position wherein said receptacle gate does not cover the first opening in said modular receptacle base module.

10. The modular subsea control pod assembly according to claim 9, wherein said modular receptacle base module has an outer surface and said second means for positioning comprises:

a plurality of grooves in said modular receptacle base module;

a plurality of ridges in said receptacle gate, said plurality of ridges in slidable engagement with the plurality of grooves such that said receptacle gate is capable of movement along said outer surface of said modular receptacle base module; and at least one spring having a first end acting against said receptacle gate and a second end acting against said modular receptacle base module such that said spring maintains said receptacle gate in said first position when said modular stab block is not received in said modular receptacle base module and said spring compresses when said modular stab block is received in said modular receptacle base module allowing said receptacle gate to slide away from the first opening in said modular receptacle base module.

* * * * *